US006782233B2

(12) United States Patent
Condello et al.

(10) Patent No.: US 6,782,233 B2
(45) Date of Patent: Aug. 24, 2004

(54) EXTERNALLY HEATED THICK BELT FUSER

(75) Inventors: Anthony S. Condello, Webster, NY (US); Mark S. Amico, Rochester, NY (US); John S. Berkes, Webster, NY (US); Donald M. Bott, Rochester, NY (US); Derek E. Vaughan, Rockford, IL (US)

(73) Assignee: Xerox Corporation, Stamford, CT (US)

( * ) Notice: Subject to any disclaimer, the term of this patent is extended or adjusted under 35 U.S.C. 154(b) by 41 days.

(21) Appl. No.: 10/093,263

(22) Filed: Mar. 8, 2002

(65) Prior Publication Data

US 2003/0170056 A1 Sep. 11, 2003

(51) Int. Cl.[7] ..... G03G 15/20
(52) U.S. Cl. ..... 399/329; 399/333
(58) Field of Search ..... 399/328, 329, 399/333

(56) References Cited

U.S. PATENT DOCUMENTS

| | | | | | |
|---|---|---|---|---|---|
| 4,791,447 | A | * | 12/1988 | Jacobs | 399/328 X |
| 5,250,998 | A | | 10/1993 | Ueda et al. | 355/285 |
| 5,716,714 | A | * | 2/1998 | Chen et al. | 428/473.5 |
| 5,724,628 | A | | 3/1998 | Sano | 399/33 |
| 5,758,245 | A | | 5/1998 | Matsuura et al. | 399/329 |
| 5,778,294 | A | | 7/1998 | Hiraoka et al. | 399/329 |
| 5,873,020 | A | | 2/1999 | Matsuura et al. | 399/329 |
| 5,890,047 | A | * | 3/1999 | Moser | 399/329 |
| 5,895,153 | A | | 4/1999 | Aslam et al. | 399/329 |
| 5,927,189 | A | | 7/1999 | Jones et al. | 101/23 |
| 5,974,294 | A | * | 10/1999 | Tange | 399/328 |
| 5,999,764 | A | | 12/1999 | Okabayashi et al. | 399/67 |
| 6,070,045 | A | | 5/2000 | Hara et al. | 399/325 |
| 6,091,926 | A | | 7/2000 | Yamada | 399/329 |
| 6,096,427 | A | * | 8/2000 | Chen et al. | 399/329 X |
| 6,198,902 | B1 | * | 3/2001 | Vaughan et al. | 399/329 |
| 6,263,183 | B1 | * | 7/2001 | Schlueter et al. | 399/329 |
| 6,272,309 | B1 | | 8/2001 | Kitazawa et al. | 399/333 |
| 6,282,398 | B1 | | 8/2001 | Higashi | 399/329 |

* cited by examiner

*Primary Examiner*—Fred L. Braun
(74) *Attorney, Agent, or Firm*—Annette L. Bade

(57) ABSTRACT

A heat and pressure belt fuser structure having an endless belt and a pair of pressure engageable members between which the endless belt is sandwiched for forming a fusing nip through which substrates carrying toner images pass with the toner images contacting an outer surface of the endless belt, at least one of the pressure engageable members has a deformable layer, and the endless belt has a thickness of from about 1 to about 8 mm; and the fuser structure includes an external source of thermal energy for elevating a pre-nip area of the belt. The thick belt in combination with a deformable layer of at least one of the pressure member(s) cooperate to provide a large nip and adequate creep for intrinsic paper stripping.

19 Claims, 9 Drawing Sheets

| EHR = 200 C, 3 mm Fuser Belt w Viton Overcoat<br>Amino Oil at 7 - 10 ul/sheet, Polyester Toner, 1 mg/cm2, Stress Image | | | | |
|---|---|---|---|---|
| | 8% Creep - Calculated Classical<br>IPR Rubber = 0 mm<br>468 mm/sec, 27 ms Dwell<br>307 mm/sec, 40 ms Dwell<br>120 psi | | 1% Creep - Calculated Classical<br>IPR Rubber = 15 mm<br>468 mm/sec, 40 ms Dwell<br>80 psi | |
| Paper Type | New Belt<br>< 10K Prints | Old Belt<br>> 200K Prints | New Belt<br>< 10K Prints | Old Belt<br>> 200K Prints |
| Potlatch<br>NWG 60#<br>90 gsm | Yes | Yes | No | No |
| Hammermill<br>Accent Opaque<br>67 gsm | Yes | Yes | No | No |
| S D Warren<br>Lustro Gloss 80#<br>120 gsm | Yes | Yes | Yes | No |
| Xerox<br>CX<br>90 gsm | Yes | Yes | Yes | No |

FIG.8

| Configurations -> | | R15(45)xB3(48) Original | R0xB3(48) | R5(70)xB4.5(48) | R7(45)xB4.5(48) Possible | R5(70)xB3(48) Preferred |
|---|---|---|---|---|---|---|
| IPR Rubber | Thickness | 15 mm | 0 mm | 5 mm | 7 mm | 5 mm |
| | ShoreA | 45 | na | 70 | 45 | 70 |
| Belt | Thickness | 3 mm | 3 mm | 4.5mm | 4.5mm | 3mm |
| | ShoreA | 48 | 48 | 48 | 48 | 48 |
| Fusing Nip | Width | 19 mm | 12 mm | 17 mm | 18 mm | 14 mm |
| | Pressure | 80 psi | 125 psi | 100psi | 100psi | 110 psi |
| Creep | Measured | -1.7% | 12% | 11.3% | 5% | 6.2% |
| Max Speed @ 30 ms | mm/s | 633 mm/s | 400 mm/s | 567 mm/s | 600 mm/s | 467 mm/s |
| | ppm | 135 ppm | 85 ppm | 121 ppm | 128 ppm | 100 ppm |
| Dwell @ | 352 mm/s | 54 ms | 34 ms | 48 ms | 51 ms | 40 ms |
| | 468 mm/s | 40 ms | 26 ms | 36 ms | 38 ms | 30 ms |
| Fusing Nip Width | | Large Nip | Small Nip | Large Nip | Large Nip | Medium Nip |
| Creep | | Low Creep | High Creep | High Creep | Medium Creep | Medium Creep |
| Paper Edge Abrasion | | Low | High | High | Medium | Medium |
| Paper Stripping | | Poor | Excellent | Excellent | Good | Good |
| Belt Life | | Excellent | Poor | Poor | Good | Good |

FIG. 9

EXTERNALLY HEATED THICK BELT FUSER

BACKGROUND OF THE INVENTION

This invention relates generally to an electrostatographic, including digital, apparatus, and more particularly, it relates to heat and pressure fusing members for fixing images to a final substrate. In embodiments, the invention relates to fuser and pressure members useful in a high-speed color xerographic apparatus.

In a typical electrophotographic copying or printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to a donor roll is then deposited as latent electrostatic images on a charge-retentive photoconductive surface, such as a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support member or otherwise upon the surface thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members, at least one of which is internally heated. During operation of a fusing system of this type, the support member to which the toner images are electrostatically adhered is moved through a nip formed between the rolls with the toner image contacting the heated fuser roll to thereby effect heating of the toner images within the nip. In a Nip Forming Fuser Roll (NFFR), the heated fuser roll is provided with a layer or layers that are deformable by a harder pressure roll when the two rolls are pressure engaged. The length of the nip and process speed determines the dwell time or time that the toner particles remain in contact with the surface of the heated roll.

The heated fuser roll is usually the roll that contacts the toner images on a substrate such as plain paper. In any event, the roll contacting the toner images is usually provided with an adhesive (low surface energy) material for preventing toner offset to the fuser member. Three materials, which are commonly used for such purposes, are fluoropolymers, fluoroelastomers and silicone rubber.

Roll fusers work very well for fusing color images at low speeds since the required process conditions such as temperature, pressure and dwell can easily be achieved. When process speeds approach 100 pages per minute (ppm), roll fusing performance starts to falter. As fusing speed increases, dwell time must remain constant, which means an increase in nip width. Increasing the nip width can be accomplished by either increasing the fuser roll rubber thickness, and/or reducing the modulus and/or the outside diameter of the roll. However, each of these solutions reach their maximum effectiveness at about 100 ppm. Specifically, for an internally heated fuser roll, the rubber thickness is limited by the maximum temperature the rubber can withstand, and the thermal gradient across the elastomer layer. The roll size also becomes a critical issue for reasons of space, weight, cost and stripping.

Following is a discussion of references, the disclosures each of which are hereby incorporated by reference in their entirety.

U.S. Pat. No. 4,242,566 discloses a heat and pressure fusing apparatus that exhibits high thermal efficiency. The fusing apparatus comprises at least one pair of first and second oppositely driven pressure fixing feed rollers, each of the rollers having an outer layer of a thermal insulating material; first and second idler rollers, a first flexible endless belt disposed about the first idler roller and each of the first pressure feed rollers and a second flexible endless belt disposed about the second idler roller and each of the second pressure feed rollers, at least one of the belts having an outer surface formed of a thermal conductive material, wherein there is defined an area of contact between the outer surfaces of the first and second belts located between the first and second pressure feed rollers for passing the copy sheet between the two belts under pressure; and means spaced relative to the belt whose outer surface comprises the thermal conductive material for heating the outer surface thereof, whereby when an unfused copy sheet is passed through the area of contact between the two belts it is subject to sufficient heat and pressure to fuse developed toner images thereon.

U.S. Pat. No. 4,582,416 discloses a heat and pressure fusing apparatus for fixing toner images. The fusing apparatus is characterized by the separation of the heat and pressure functions such that the heat and pressure are effected at different locations on a thin flexible belt forming the toner-contacting surface. A pressure roll cooperates with a stationary mandrel to form a nip through which the belt and copy substrates pass simultaneously. The belt is heated such that by the time it passes through the nip its temperature together with the applied pressure is sufficient for fusing the toner images passing through.

U.S. Pat. No. 4,992,304 discloses a fuser belt for a reproduction machine. The belt may have one of several configurations which all include ridges and interstices on the outer surface which contacts the print media. These interstices are formed between regularly spaced ridges, between randomly spaced particles, between knit threads. These interstices allow the free escape of steam from the media during high-temperature fusing of the reproduction process. As the steam escapes freely, the steam does not accumulate in the media causing media deformations and copy quality deterioration. Additionally, media handling is improved because the ridges and interstices reduce the unwanted but unavoidable introduction of thermal energy into the copy media.

U.S. Pat. No. 5,250,998 discloses a toner image fixing device wherein there is provided an endless belt looped up around a heating roller and a conveyance roller, a pressure roller for pressing a sheet having a toner image onto the heating roller with the endless belt intervening between the pressure roller and the heating roller. A sensor is disposed inside the loop of the belt so as to come in contact with the heating roller, for detecting the temperature of the heating roller. The fixing temperature for the toner image is controlled on the basis of the temperature of the heating roller detected by the sensor. A first nip region is formed on a pressing portion located between the heating roller and the fixing roller. A second nip region is formed between the belt and the fixing roller, continuing from the first nip region but without contacting the heating roller.

U.S. Pat. No. 5,349,424 discloses a heated, thick-walled, belt fuser for an electrophotographic printing machine. The belt is rotatably supported between a pair of rolls. One of the spans of the belt is in contact with a heating roll in the form of an aluminum roll with an internal heat source such as a quartz lamp. The belt is able to wrap a relatively large portion of the heating roll to increase the efficiency of the heat transfer. The second span of the belt forms an extended fusing nip with a pressure roll. The extended nip provides a greater dwell time for a sheet in the nip while allowing the fuser to operate at a greater speed. External heating enables a thick profile of the belt, which in turn allows the belt to be reinforced so as to operate at greater fusing pressures without degradation of the image. The thick profile and external heating of the belt also provides a much more robust design than conventional thin walled belt fusing systems.

U.S. Pat. No. 5,465,146 relates to a fixing device to be used in electrophotographic apparatus for providing a clear fixed image with no offset with use of no oil or the least amount of oil, wherein an endless fixing belt provided with a metal body having a release thin film thereon is stretched between a fixing roller having a elastic surface and a heating roller, a pressing roller is arranged to press the surface of the elastic fixing roller upwardly from the lower side thereof through the fixing belt to form a nip portion between the fixing belt and the pressing roller, a guide plate for unfixed image carrying support member is provided underneath the fixing belt, between the heating roller and the nip portion, to form substantially a linear heating path between the guide plate and the fixing belt, and the metal body of the fixing belt has a heat capacity per $cm^2$ within the range of 0.001 to 0.02 cal/° C.

U.S. Pat. No. 5,890,047 discloses a combination belt and roll fuser having a pair of pressure engagable rolls with a belt looped or wrapped around one of the pressure engageable rolls such that the belt is sandwiched therebetween. The belt is deformed due to the force exerted by the pressure rolls such that it forms a single fusing nip. An internally heated, thermally conductive roll contacts a portion of the belt externally at a pre-nip location for elevating its temperature. The pressure engageable roll about which the belt is entrained is internally heated during warm-up for minimizing droop.

In order to enable high fusing speeds for color xerographic toner, large fusing nips are necessary, along with a durable fuser surface for gloss maintenance through fuser life. One way to achieve the high fusing nips is to increase the surface area of the fuser by using a thick elastomer belt instead of a fuser roll for the fusing element. Due to poor thermal conductivity, however, it is usually necessary for the thick elastomer belt to be front surface heated through an extended contact zone with a heater roll. To create a large nip for an extended fusing dwell time, it is desired that the belt be as thick as possible. However, belt flexibility can be compromised with relatively large belt thicknesses. Also, additional nip width can be gained by using an elastomer coating on the internal pressure roll. Having both the elastomer on a pressure roll and the fuser belt contribute to the desired characteristics of fusing nip. The thickness and the durometer of both elastomers can be varied to obtain the desired dwell times in the fusing nip. The problem with having elastomers on both the fusing belt and pressure roll is that adequate creep (greater than about 5 percent) needs to be maintained for intrinsic paper stripping. This restricts the practical range of the thickness and the durometer of the two elastomers.

Therefore, it is desired to provide a fuser useful in fusing color toner at high speeds by maximizing the nip while still retaining adequate creep for paper stripping and maintaining belt flexibility.

BRIEF SUMMARY OF THE INVENTION

The present invention provides, in embodiments, a heat and pressure belt fuser structure, said fuser structure comprising: a plurality of members including an endless belt and a pair of pressure engageable members between which said endless belt is sandwiched for forming a fusing nip through which substrates carrying toner images pass with said toner images contacting an outer surface of said endless belt, at least one of said pressure engageable members comprising a deformable layer, wherein said endless belt has a thickness of from about 1 to about 8 mm; and an external source of thermal energy for elevating a pre-nip area of said belt.

Embodiments further include, a heat and pressure belt fuser structure, said fuser structure comprising: a plurality of members including an elastomeric endless belt and a pair of pressure engageable members between which said endless belt is sandwiched for forming a fusing nip through which substrates carrying toner images pass with said toner images contacting an outer surface of said endless belt, at least one of said pressure engageable members comprising an elastomeric deformable layer, wherein said endless belt has a thickness of from about 1 to about 8 mm, and wherein said deformable layer of said at least on pressure engageable member has a thickness of from about 1 to about 15 mm; and an external source of thermal energy for elevating a pre-nip area of said belt.

In addition, embodiments include an image forming apparatus for forming images on a recording medium comprising: a) a charge-retentive surface to receive an electrostatic latent image thereon; b) a development component to apply a developer material to the charge-retentive surface to develop the electrostatic latent image to form a developed image on the charge-retentive surface; c) transfer member for transferring the developed image from the charge-retentive surface to a copy substrate, and d) a heat and pressure belt fuser structure, said fuser structure comprising: a plurality of members including an endless belt and a pair of pressure engageable members between which said endless belt is sandwiched for forming a fusing nip through which substrates carrying toner images pass with said toner images contacting an outer surface of said endless belt, at least one of said pressure engageable members comprising a deformable layer, wherein said endless belt has a thickness of from about 1 to about 8 mm; and an external source of thermal energy for elevating a pre-nip area of said belt.

DESCRIPTION OF THE DRAWINGS

FIG. 8 is a Table showing paper stripping results for a belt fuser for high and low creep.

FIG. 9 is a Table showing fusing nip configurations and nip attributes for fusing.

DESCRIPTION OF THE INVENTION

Figure 1:
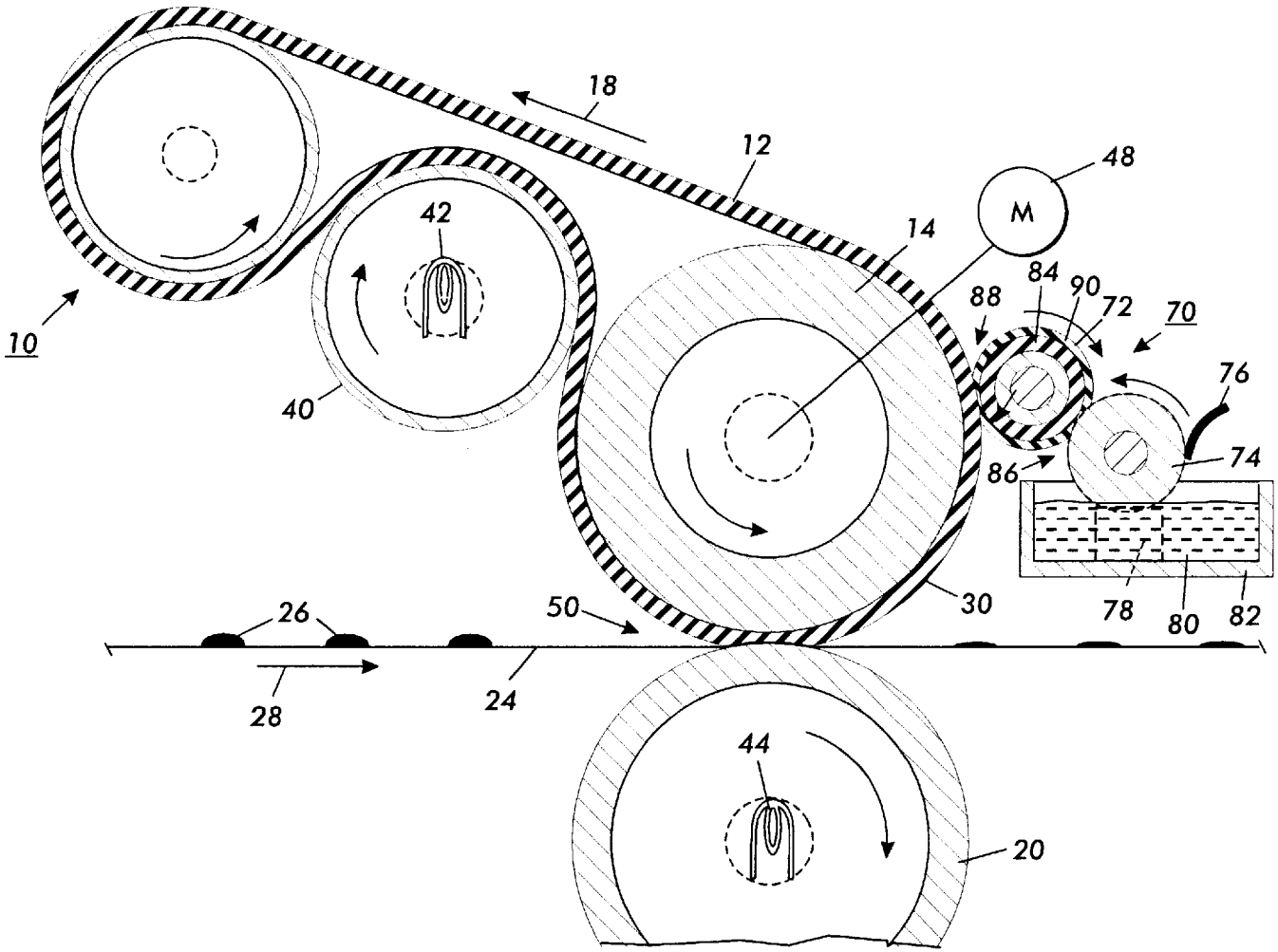
FIG. 1 is a schematic representation of a heat and pressure belt fuser according to one embodiment of the invention.

There is provided a heat and pressure belt fuser including a pair of pressure engageable rolls and an externally heated, thick fusing belt. The pressure engageable rolls and belt are supported such that the belt is sandwiched between the two pressure engageable rolls. The belt and roll about which the belt is looped are provided with one or more deformable layers which cooperate to form a single nip through which substrates carrying toner images pass with the toner images contacting the outer surface of the elastomeric belt. An external source of heat is provided, in embodiments, by contacting the outer surface of the belt in a pre-nip area.

The belt may comprise a rubber material, and in embodiments, is externally heated. The external heating allows for maximum rubber temperatures to be attained at the fusing surface without relying on heat transfer through the belt. Externally heating the belt enables larger belt thicknesses allowing for increased nip widths necessary for higher process speeds. Higher fusing surface temperatures also enable the use of higher melting toners. Therefore, the belt can be used with color toner as well as black toner.

Smaller nip pressure rolls can be used in the belt fuser since the belt thickness, not the roll diameter, is increased herein and causes generation of a large nip. Smaller roll diameters also equate to more reliable stripping. Combinations of thicknesses of the pressure roller layers and the fuser belt allow for an increased nip.

Although increasing thicknesses would normally be expected to result in "droop" of the fuser, the present configuration allows for a reduction in the "droop" of the fuser to little or no droop. Droop is defined as the reduction in FR surface temperature over time as a function of contact with ambient media and/or a cooler Pressure Roll (PR). With internally heated roll fusers, especially rolls with thick rubber layers, the droop can be significant because of the time it takes to heat through the bulk of the rubber after the paper and pressure roll (PR) start drawing heat from the FR. The effects of droop are inconsistent fix and gloss within a series of prints. The external heating of the belt replenishes the heat quickly at the belt surface prior to the belt re-entering the fusing nip, thereby eliminating the time lag caused by heating through the rubber, in the case of a roll fuser. However, the present configuration, in embodiments, reduces droop to essentially zero.

The belt also has the potential of being more environmentally friendly since only the rubber needs to be replaced when the fusing surface provided by the belt fails due to poor release. Alternatively, a roll consists of both relatively thick rubber and a metallic core, and therefore, both must be replaced upon end of life.

For a general understanding of the features of the present invention, reference is made to the drawings. In the drawings, like reference numerals have been used throughout to identify identical elements.

As disclosed in FIG. 1, one embodiment of the present invention comprises a heat and pressure belt fuser indicated generally by the reference character 10. An elastic belt 12 is supported for movement in an endless path by a pair of rolls 14 and 16. The roll 14 is one of a pair of pressure engageable rolls while the roll 16 is an idler roll cooperating with the roll 14 to support the belt 12 for movement in an endless loop or path of movement in the direction of the arrow 18. Roll 16 is also used to steer and translate the belt by gimbaling the roller. A second pressure engageable roll 20 is supported for pressure engagement with the roll 14 such that the belt 12 is sandwiched therebetween in order to form a fusing nip 50. Imaged substrates such as a sheet of plain or coated paper 24 carrying toner images 26 move in the direction of the arrow 28 pass through the nip 50 with the toner images contacting an outer surface 30 of the belt 12. The fusing nip 50 comprises a single nip, in that, the section of belt contacted by the roll 14 is coextensive with the opposite side of the belt contacted by roll 20. In other words, neither of the rolls 14 and 20 contact a section of the belt not contacted by the other of these two rolls. A single nip insures a single nip velocity and high pressure through the entire nip.

Fusing surface 30 of the belt 12 is elevated to fusing temperature by means of an internally heated roll 40 having a conventional quartz heater 42 disposed internally thereof. The roll 40 is positioned outside the belt 12. The roll 40 comprises a relatively thin (0.050 to 0.5 inch) walled metal structure chosen for its good heat conducting properties. To this end the roll 40 may be fabricated from metal such as aluminum, stainless steel, or the like and can either be anodized and/or overcoated with a thin (about 1 to about 4 mils) conductive perfluoroalkoxy (PFA).

In embodiments, a heat lamp is not present in roller 14, because it may impact the servicability of the belt module. Another quartz heating structure 44 can be disposed internally of the roll 20 for providing thermal energy only during fuser warm-up, but it is not essential. By supplying additional heat to roll 20 during extended runs with heavy paper, the phenomena commonly referred to as droop is decreased or eliminated.

A motor 48 operatively connected to the roll 14 through a conventional drive mechanism (not shown) provides for rotation of the roll 14. The frictional interface between the belt 12 and the roll 14 and between the belt 12 and the rolls 16 and 40 causes those rolls to be driven by the belt. Separate drive mechanisms (not shown) may be provided where necessary for imparting motion to the rolls 16, 20 and 40.

Figure 2:
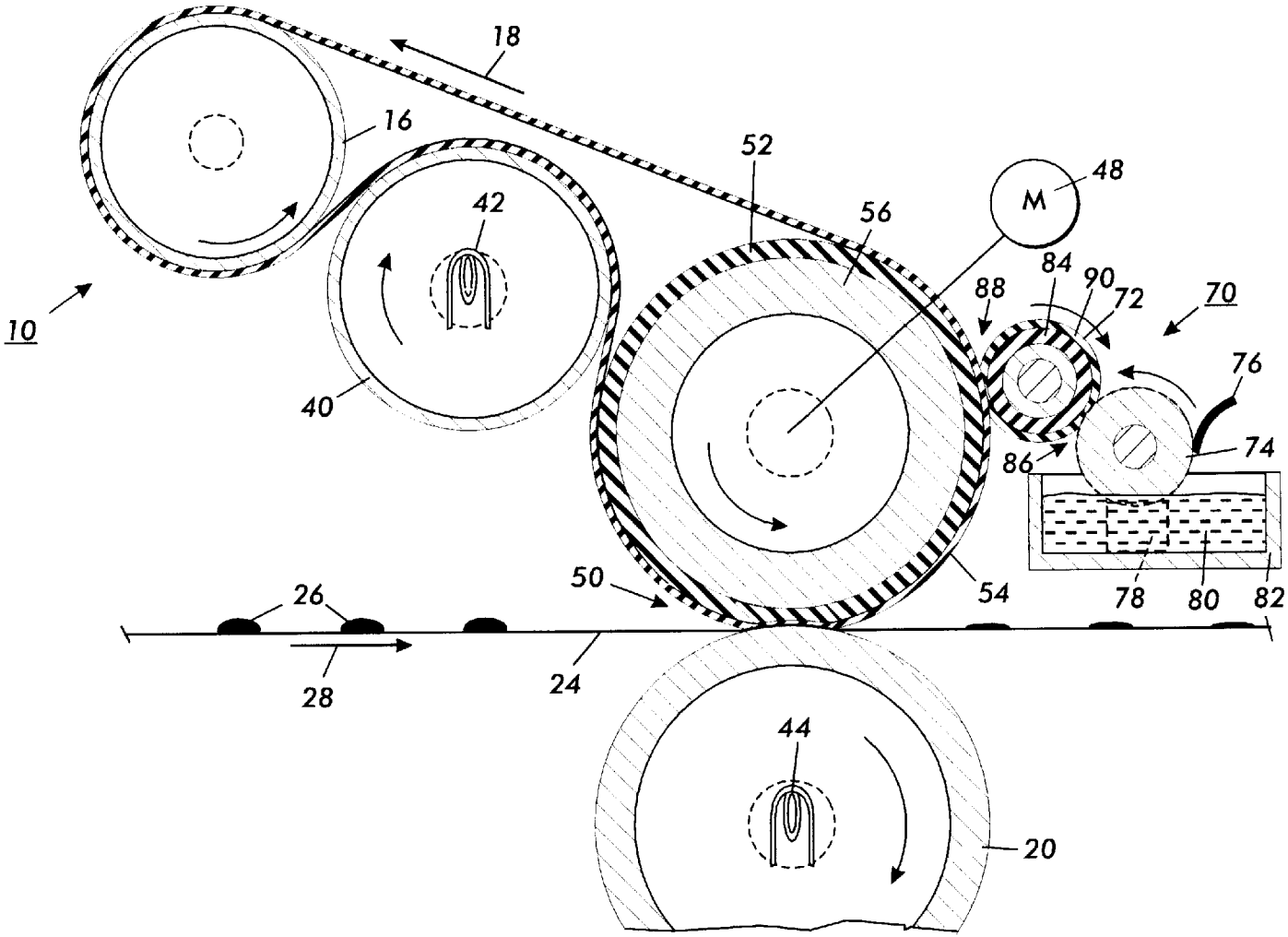
FIG. 2 is a schematic representation of another embodiment of the invention illustrated in FIG. 1 wherein there is provided a deformable layer on the internal pressure roller.

As shown in FIG. 2, a heat and pressure belt fuser according to another embodiment of the invention may have a nip 50 created by a deformable layer 52 and a fusing belt 54. The layer 52 is carried by a roll structure. When both the pressure engageable roll 56 and fusing belt 54 are employed, factors such as cost, energy transfer and belt flexibility must be considered.

Figure 3:
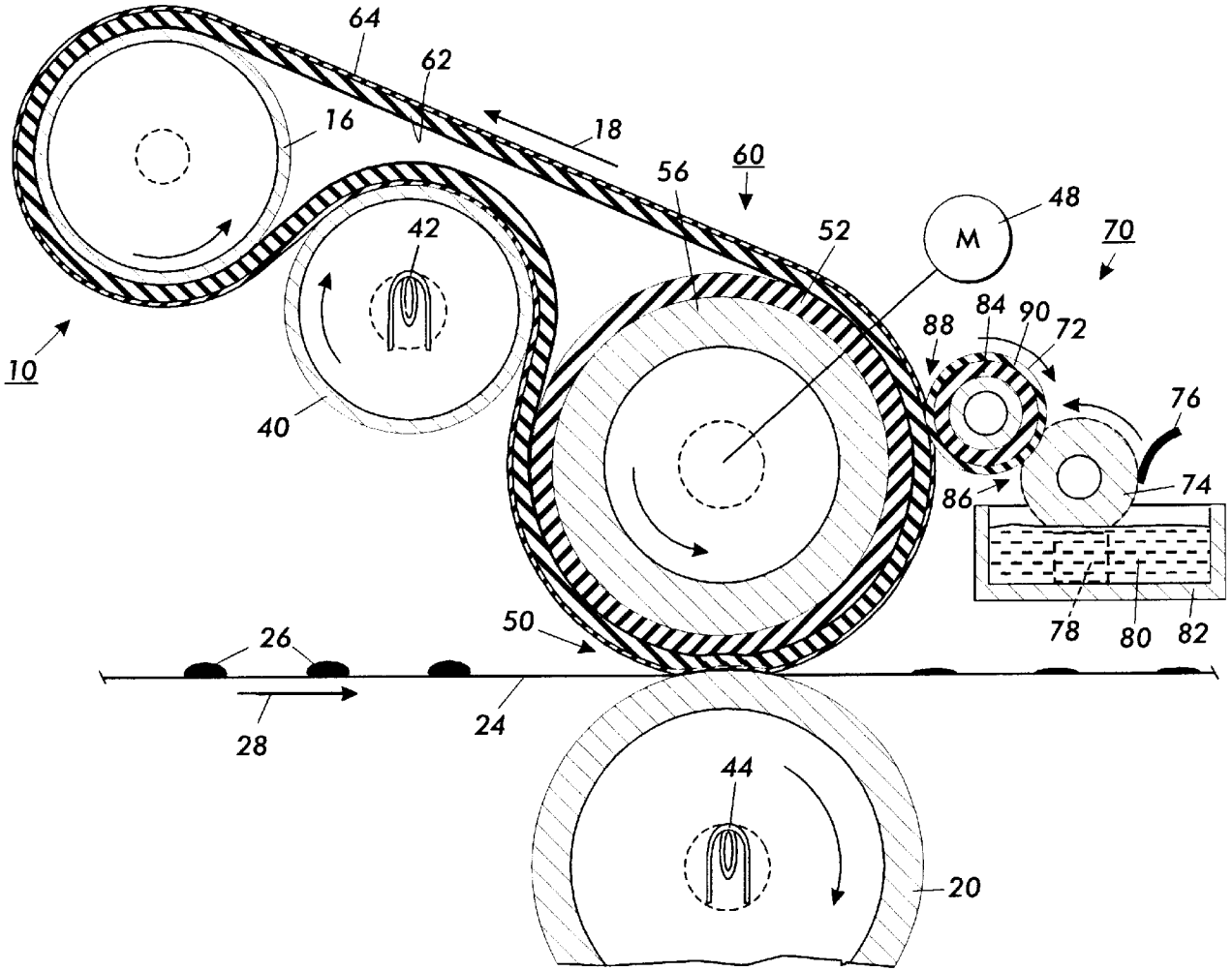
FIG. 3 is schematic representation of yet another embodiment of a heat and pressure belt fuser according to an embodiment of the invention wherein there is provided a two layer fuser belt.

As shown in FIG. 3, a fusing belt 60 may comprise a base layer 62 and an outer layer 64.

For the purpose of coating the heated belt structure 12 there is provided an optional Release Agent Management (RAM) system generally indicated by reference character 70. The mechanism 70 may be of numerous configurations and may comprise a donor roll 72, metering roll 74, doctor blade 76 and a wick 78. The metering roll 74 is partially immersed in the release agent material 80 and is supported for rotation such that it is contacted by the donor roll 72 which, in turn, is supported so as to be contacted by the fusing belt. As can be seen, the orientation of the rolls 72 and 74 is such as to provide a path for conveying material 80 from a sump 82 to the surface of the belt. The metering roll is preferably a nickel or chrome plated steel roll having a 4–32 AA finish. The metering roll has an outside diameter of from about 1.0 to about 2.0 inches. As mentioned above, the metering roll is supported for rotation, such rotation being derived by means of friction between the belt and the rotatably supported donor roll 72. The metering roll can also be driven independently. In order to permit rotation of the metering roll 74 at a practical input torque to the heated roll structure, the donor roll 72 may comprise a deformable layer 84 which forms a first nip 86 between the metering roll and the donor roll and a second nip 88 between the latter and the heated roll. The nips 84 and 88 also permit satisfactory release agent transfer between the rolls and the belt. Suitable nip lengths are from about 0.10 to about 0.2 inch.

Wick 78 is fully immersed in the release agent and contacts the surface of the metering roll 74. The purpose of the wick is to provide an air seal that disturbs the air layer formed at the surface of the roll 74 during rotation thereof. If it were not for the function of the wick, the air layer would be coextensive with the surface of the roll immersed in the release agent thereby precluding contact between the metering roll and the release agent.

The blade 76 can comprise a fluoroelastomer such as VITON®, available from Dupont. The blade can be ¾×⅛ in cross-section and have a length coextensive with the metering roll. The edge of the blade contacting the metering roll has a radius of from about 0.001 to about 0.03 inch. The blade functions to meter the release agent picked up by the roll 74 to a predetermined thickness, such thickness being of such a magnitude as to result in several microliters of release agent consumption per copy. The donor roll 72 has an outside diameter of about 1.0-inch when the metering roll outside diameter equals 1.0 inch. It will be appreciated that other dimensional combinations will yield satisfactory results. For example, a donor roll diameter of about 1.5-inch has been employed. The deformable layer 84 of the donor roll may comprise silicone rubber. However, other materials may also be employed.

A thin sleeve 90 on the order of several mils constitutes the outermost surface of the roll 72. The sleeve material comprises TEFLON®, VITON® or any other material that will impede penetration of silicone oil into the silicone rubber. While the donor rolls may be employed without the sleeve 90, it has been found that when the sleeve is used, the integrity of the donor roll is retained over a longer period and contaminants such as lint on the belt will not readily transfer to the metering roll 74. Accordingly, the material in the sump will not become contaminated by such contaminants.

Figure 4:
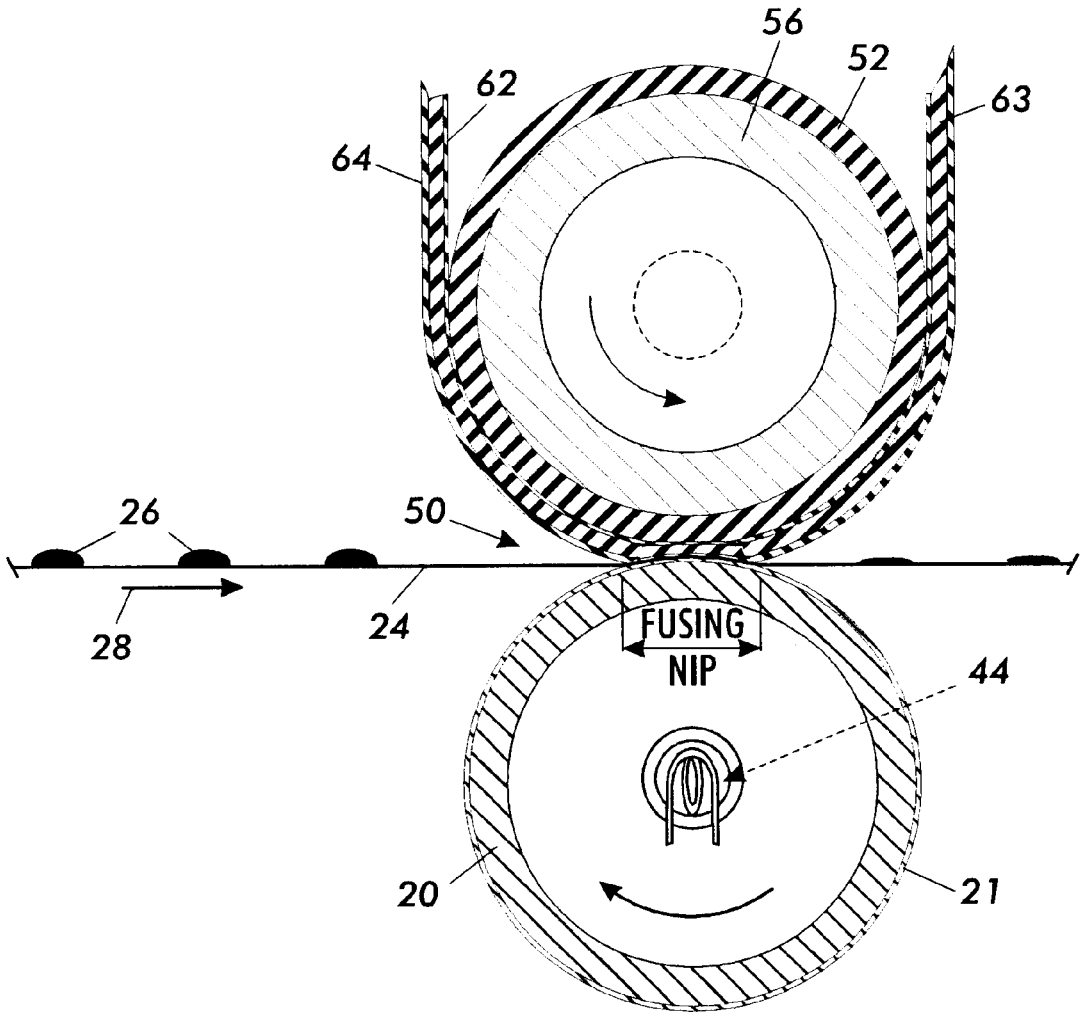
FIG. 4 is an enlarged view of an embodiment of the internal and external pressure rollers, demonstrating a thick fuser belt having 3 layers.

FIG. 4 demonstrates an embodiment of the fusing belt, including substrate 62, intermediate layer 63, and outer layer 64. In embodiments, the substrate can be a polyimide such as, in embodiments, polyamide imide woven fabric such as NOMEX®, available from DuPont. The intermediate layer 63 can be silicone bonded to the top of the polyimide and impregnated into it, or can be a fluoropolymer or the like. Outer release layer 64 can be a silicone material such as polydimethylsiloxane or a fluoropolymer such as a fluoroelastomers. A commercially available example of a fluoroelastomer is sold under the name VITON® from DuPont.

The fuser belt has a thickness of from about 1 to about 8 mm, or from about 2 to about 7 mm, or from about 3 to about 6, or from about 3 to about 4 or about 4.5 mm. This thickness is considerably higher than previous belts such as that disclosed in U.S. Pat. No. 5,890,047, which disclosed a thickness of 0.006 to 0.125 inch. In embodiments wherein the fuser belt has two or three or more layers, the outer layer of the fuser belt is from about 10 to about 100 micrometers, or from about 20 to about 40 micrometers thick. The intermediate layer is from about 2 to about 6 mm thick, or from about 3 to about 4.5 mm thick. The durometer of the intermediate layer is from about 35 to about 70, or from about 45 to about 55 Shore A. The deformable belt 12 provides the same function as the deformable layer of a Nip Forming Fuser Roll (NFFR), that is, it is self-stripping. The relatively thick belt allows for a relatively high creep which is advantageous for paper stripping.

The creep can be from about 0 to about 15, or from about 4 to about 9 percent.

The internal pressure roller 14 may comprise a metal roller, or may have an outer elastomeric layer thereon. Examples of suitable elastomers for the internal pressure roller layer include silicone rubbers, fluoroelastomers such as VITON®, and the like. The thickness of the internal pressure roll optional outer layer is from about 1 to about 15 mm, or from about 4 to about 7 mm. The durometer of the outer elastomer layer is from about 35 to about 80, or from about 50 to about 70 Shore A.

The external pressure roller 20 may be a metal roller, and may comprise an outer layer 21 thereon. Such an optional outer layer may comprise a plastic material such as a fluoropolymer, for example, TEFLON®, or the like plastics. The outer layer of the external pressure roller may have a thickness of from about 1 to about 4 mils, or from about 2 to about 3 mils.

The fusing nip 50, as shown in FIG. 4, can be from about 20 to about 28 mm, or from about 12 to about 18 mm. The fusing nip pressure is from about 80 to about 120 psi.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example 1

Preparation of Thick Fuser Belt

A belt carcass was obtained from Habisit ABT Company of Middletown, Conn., and was overcoated with a fluoroelastomer (a VITON® such as VITON® GF, from DuPont) by a flow coating process.

Example 2

Velocity Modeling for Thick Belt Fuser

The belt fuser prepared in accordance with Example 1 was modeled by a finite element computational method.

Figure 5:
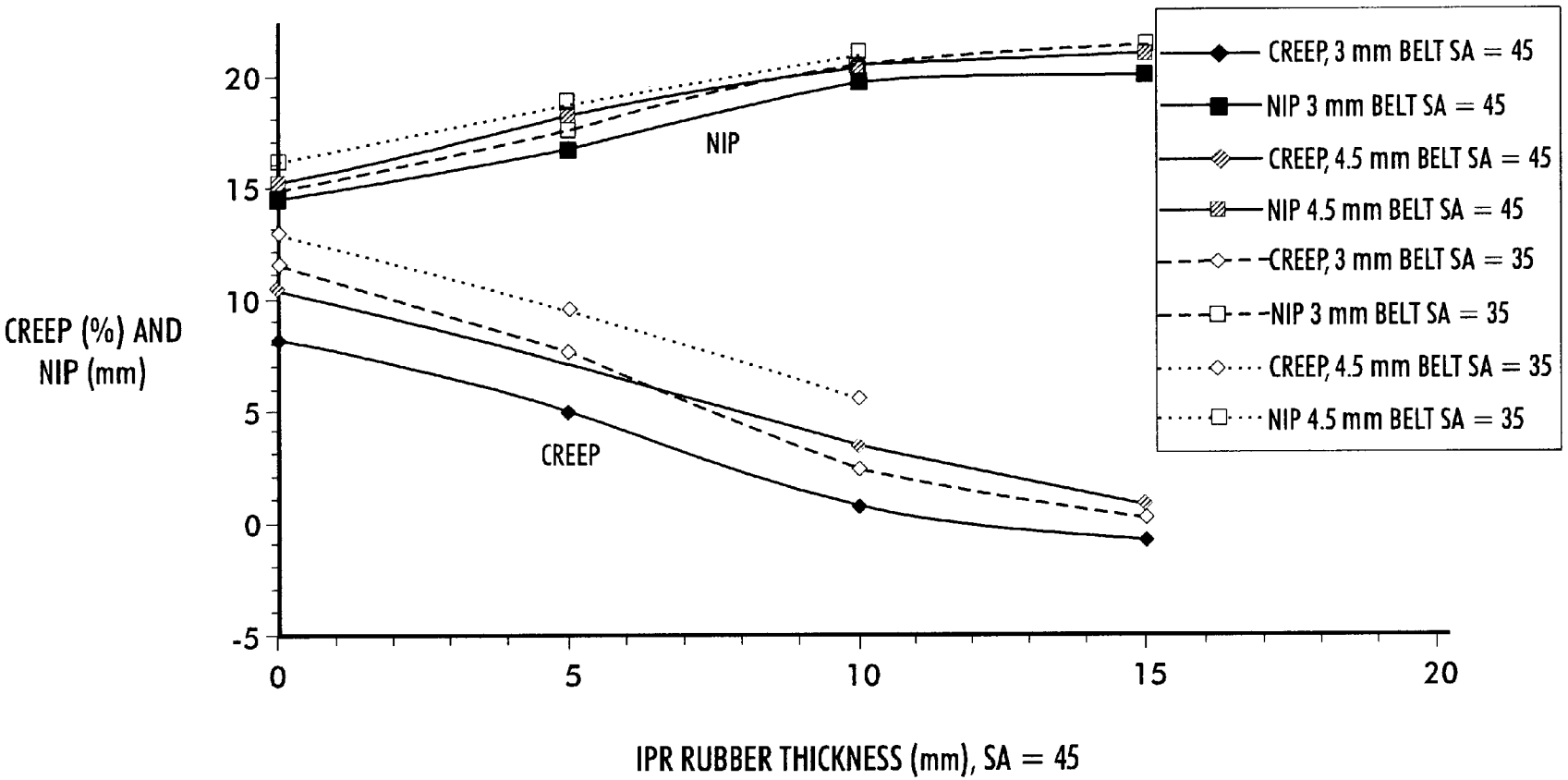
FIG. 5 is a modeling graph of creep percent and nip thickness versus internal pressure roller layer thickness.

The modeling was carried out to quantify the nip width and creep as a function of internal pressure roll (IPR) and belt rubber thickness and durometer. The modeling results are shown in FIG. 5. These results demonstrate that the creep in the fusing nip is strongly dependent on the IPR rubber thickness. Maximum creep is obtained with no rubber on the IPR and all the rubber in the belt. A very large nip width is obtained by making the IPR rubber very thick. However, this results in very low creep and makes paper stripping difficult without stripper fingers. For example, the use of 14 mm IPR and 3 mm belt rubber (Shore A of 45) resulted in a calculated creep of about 1 percent. Softer IPR rubber does not significantly change this low level of creep. The most efficient way to increase the creep is to minimize the IPR rubber thickness and increase the belt rubber thickness as much as possible. Alternatively, the same results can be obtained by increasing the internal pressure roll rubber hardness and decreasing the belt rubber hardness as much as possible.

Example 3

Experimental Creep Results for Thick Belt Fuser

Experiments were carried out to determine the creep measurements as a function of belt thickness. The fuser belt prepared in accordance with Example 1 was tested using a belt fuser as shown in FIG. 4. The total nip load was about 1,000 to about 1,100 pounds. The belts tested had a durometer of about 48 Shore A. The curves were constructed by combining different internal pressure roll and belt rubber thicknesses and measuring the velocity of the belt and external pressure roll and calculating the creep by the equation shown below.

$$\text{Creep\%}=((V(\text{EPR})-V(\text{Belt}))/V(\text{Belt}))\times 100$$

Figure 6:
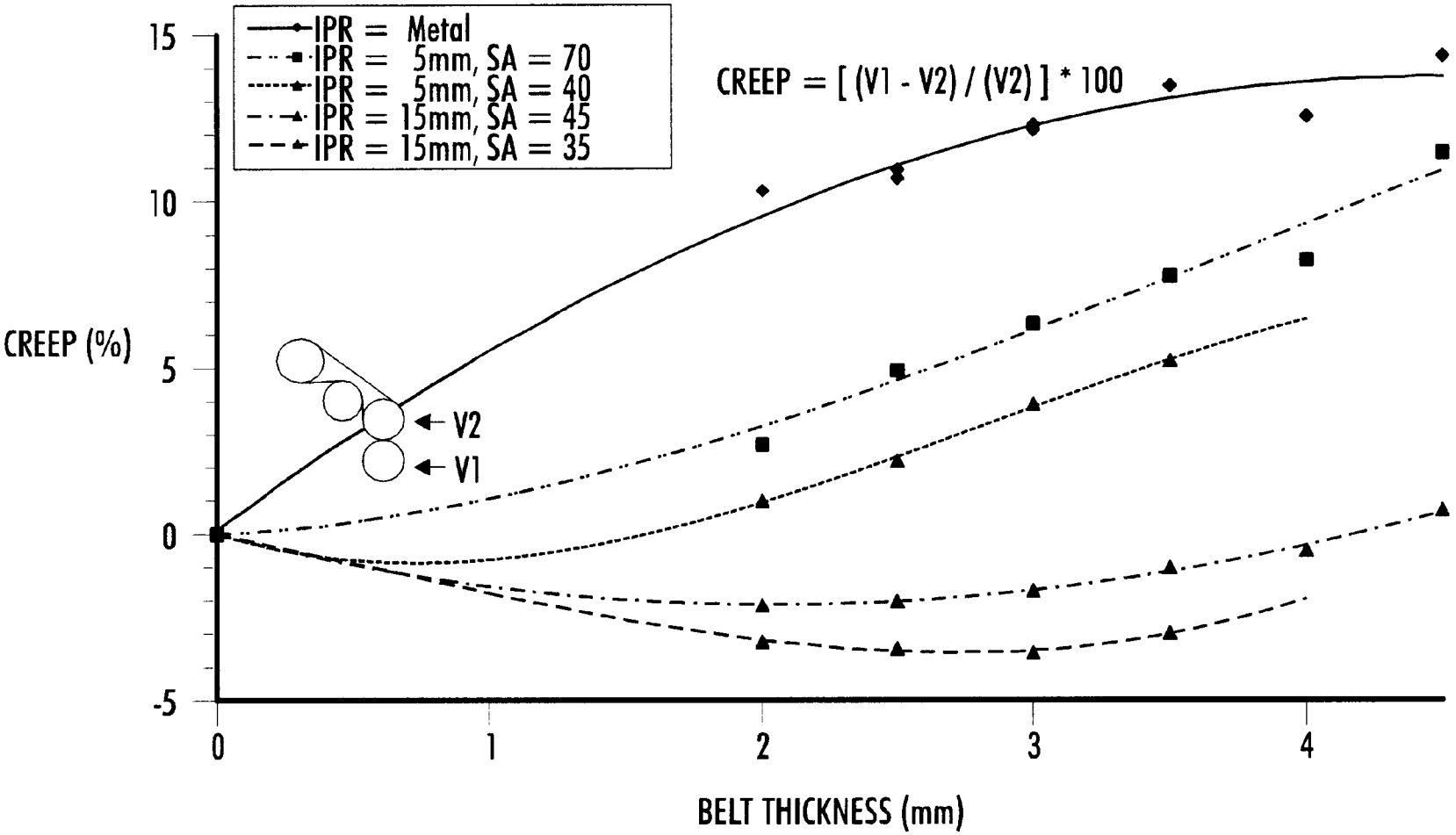
FIG. 6 is a graph showing actual test results of creep percent versus belt thickness and internal pressure roller layer thickness and durometer.

The results are shown in FIG. 6. The results generally confirm the calculated results. One difference between theory and experiment is that measurements do indicate the presence of a larger positive creep for the bare IPR case.

Figure 7:
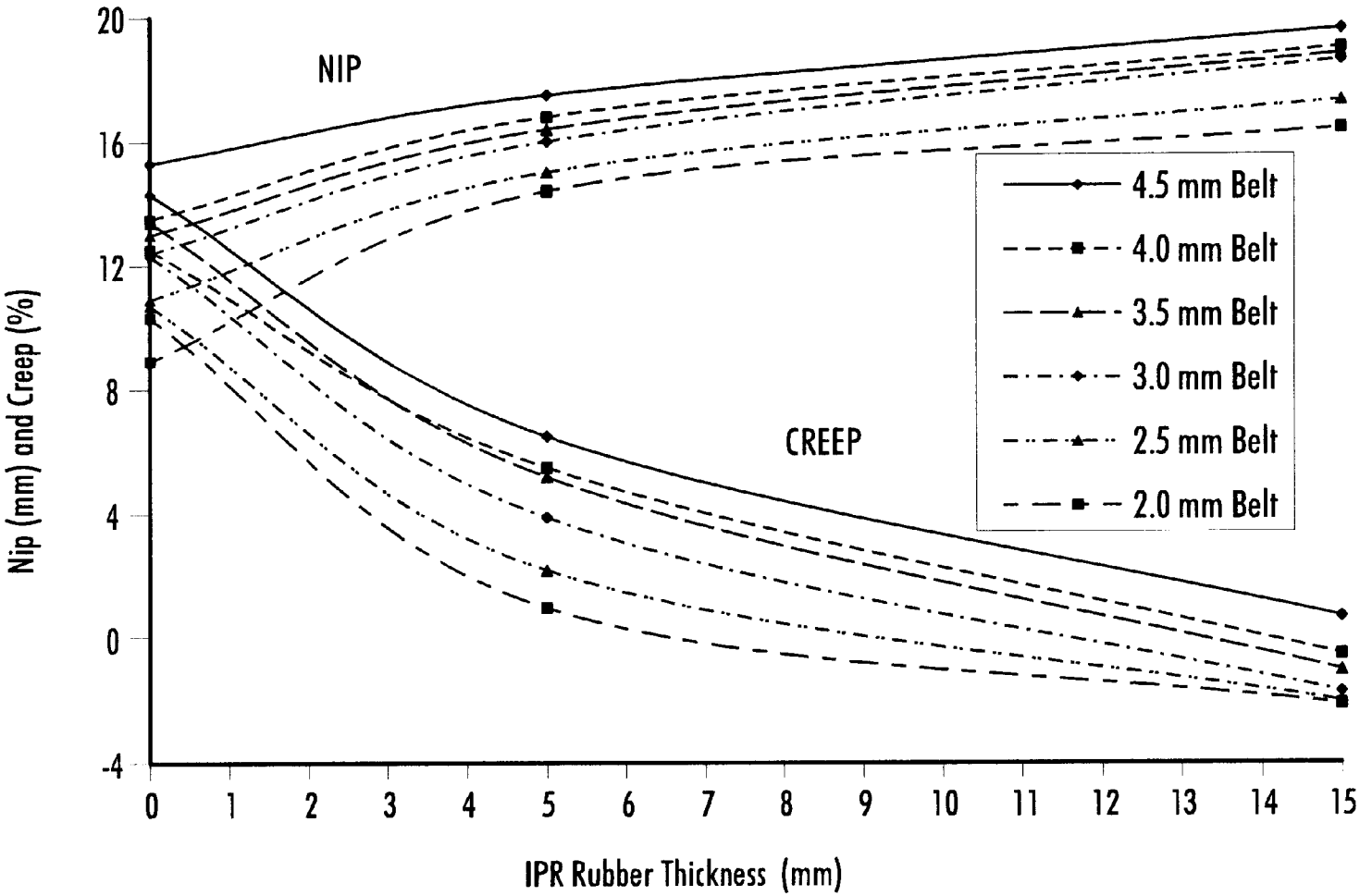
FIG. 7 is an experimental graph of creep percent and nip width versus internal pressure roller layer thickness.

FIG. 7 gives the measured creep and nip as a function of IPR rubber thickness for an IPR durometer of about 45 to about 48 Shore A. The rolls were 4-inch rolls, and the total load was about 1050 pounds. These experimental results in FIG. 7 confirm the computer modeling results shown in FIG. 5.

Example 4

Paper Stripping Results for Thick Belt Fuser

Paper stripping experiments confirm the creep model for intrinsic paper stripping. The paper stripping experiments were carried out as follows. The belt fuser was operated at the fusing conditions specified in FIG. 8. Sheets of paper with unfused toner on them were fed through the engaged nip. A stripping failure manifested itself by a failure of the paper to separate from the fusing belt. The results are shown in FIG. 8.

A series of stripping tests with high and low creep nip properties using an old (200K) and a new fuser belt and a range of papers, demonstrated that high creep configuration enabled the stripping of all papers from both a new belt and from an old belt. The low creep configuration did not strip light weight paper from the new belt and any paper from an old belt.

Example 5

Fuser Nip Configurations for Thick Belt Fuser

Nip characteristics of IPR and belt rubber combinations are given in FIG. 9. The first nip design in FIG. 9 had 15 mm of IPR rubber and a 3 mm thick belt which resulted in a very large nip (about 19 mm). This was shown to be good for high speed fusing, but had essentially no creep (about −1.7%) and consequently would not strip paper. However, paper edge abrasion would have been low.

The second nip design in FIG. 9 had no IPR rubber and a 3 mm belt. The resulting nip was small (about 12 mm) and had very high creep (about 12 mm). This combination was not applicable for high speed fusing because although paper would strip very well, high paper edge abrasion resulted, along with early belt failure due to high internal strain energy.

The third nip design in FIG. 9 used a thicker belt of about 4.5 mm, which increased the nip width (about 17 mm), but the creep was too high (about 11.3%) and resulted in early belt failure.

Examples of superior configurations are typified by the last two shown in FIG. 9. These two configurations (and others with similar rubber dimensions) demonstrated reasonable nip size for speed, reasonable creep for paper stripping, minimal paper edge abrasion, and longer belt life.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

What is claimed is:

1. A heat and pressure belt fuser structure, said fuser structure comprising:

a plurality of members including an endless belt and a pair of pressure engageable members between which said endless belt is sandwiched for forming a fusing nip through which substrates carrying toner images pass with said toner images contacting an outer surface of said endless belt, at least one of said pressure engageable members comprising a deformable layer, wherein said endless belt has a thickness of from about 1 to about 8 mm, and has a durometer of from about 35 to about 70 Shore A, and an external source of thermal energy for elevating a pre-nip area of said belt.

2. A heat and pressure belt fuser structure in accordance with claim 1, wherein said thickness of said endless belt is from about 2 to about 7 mm.

3. A heat and pressure belt fuser structure in accordance with claim 2, wherein said thickness of said endless belt is from about 3 to about 4.5 mm.

4. A heat and pressure belt fuser structure in accordance with claim 1, wherein said endless belt has a durometer of from about 45 to about 55 Shore A.

5. A heat and pressure belt fuser structure in accordance with claim 1, wherein said deformable layer of said at least one pressure engageable member has a thickness of from about 1 to about 15 mm.

6. A heat and pressure belt fuser structure in accordance with claim 5, wherein said deformable layer of said at least one pressure engageable member has a thickness of from about 4 to about 7 mm.

7. A heat and pressure belt fuser structure in accordance with claim 1, wherein said deformable layer of said at least one pressure engageable member has a durometer of from about 35 to about 80.

8. A heat and pressure belt fuser structure in accordance with claim 7, wherein said deformable layer of said at least one pressure engageable member has a durometer of from about 50 to about 70 Shore A.

9. A heat and pressure belt fuser structure in accordance with claim 1, wherein said fusing nip is from about 10 to about 28 mm.

10. A heat and pressure belt fuser structure in accordance with claim 9, wherein said fusing nip is from about 12 to about 18 mm.

11. A heat and pressure belt fuser structure in accordance with claim 1, wherein said fusing nip has a pressure of from about 80 to about 120 psi.

12. A heat and pressure belt fuser structure in accordance with claim 1, wherein said endless belt comprises at least one layer comprising an elastomeric material.

13. A heat and pressure belt fuser structure in accordance with claim 12, wherein said endless belt comprises a substrate and an outer elastomeric layer thereon.

14. A heat and pressure belt fuser structure in accordance with claim 1, wherein said toner comprises color toner.

15. A heat and pressure belt fuser structure, said fuser structure comprising:

a plurality of members including an endless belt and a pair of pressure engageable members between which said endless belt is sandwiched for forming a fusing nip through which substrates carrying toner images pass with said toner images contacting an outer surface of said endless belt, at least one of said pressure engageable members comprising a deformable layer, wherein said endless belt has a thickness of from about 1 to about 8 mm; wherein said endless belt comprises a substrate having an outer elastomeric layer thereon and an intermediate elastomeric layer positioned between said substrate and said outer elastomeric layer, and an external source of thermal energy for elevating a pre-nip area of said belt.

16. A heat and pressure belt fuser structure in accordance with claim 15, wherein said intermediate elastomeric layer has a thickness of from about 1 to about 8 mm.

17. A heat and pressure belt fuser structure in accordance with claim 15, wherein said intermediate layer has a thickness of from about 2 to about 6 mm.

18. A heat and pressure belt fuser structure, said fuser structure comprising:

a plurality of members including an elastomeric endless belt and a pair of pressure engageable members between which said endless belt is sandwiched for forming a fusing nip through which substrates carrying toner images pass with said toner images contacting an outer surface of said endless belt, at least one of said pressure engageable members comprising an elastomeric deformable layer, wherein said endless belt has a thickness of from about 1 to about 8 mm, and has a durometer of from about 35 to bout 70 Shore A, and wherein said deformable layer of said at least one pressure engageable member has a thickness of from about 1 to about 15 mm; and an external source of thermal energy for elevating a pre-nip area of said belt.

19. An image forming apparatus for forming images on a recording medium comprising:

a) a charge-retentive surface to receive an electrostatic latent image thereon;

b) a development component to apply a developer material to the charge-retentive surface to develop the electrostatic latent image to form a developed image on the charge-retentive surface;

c) transfer member for transferring the developed image from the charge-retentive surface to a copy substrate, and d) a heat and pressure belt fuser structure, said fuser structure comprising: a plurality of members including an endless belt and a pair of pressure engageable members between which said endless belt is sandwiched for forming a fusing nip through which substrates carrying toner images pass with said toner images contacting an outer surface of said endless belt, at least one of said pressure engageable members comprising a deformable layer, wherein said endless belt has a thickness of from about 1 to about 8 mm, and has a durometer of from about 35 to about 70 Shore A, and an external source of thermal energy for elevating a pre-nip area of said belt.

* * * * *